US007909630B2

(12) United States Patent
Yamada

(10) Patent No.: US 7,909,630 B2
(45) Date of Patent: Mar. 22, 2011

(54) ELECTRICAL CONNECTOR HAVING CONTACT PORTION

(75) Inventor: Wataru Yamada, Tokyo (JP)

(73) Assignee: Hirose Electric Co., Ltd, Tokyo (JP)

( * ) Notice: Subject to any disclaimer, the term of this patent is extended or adjusted under 35 U.S.C. 154(b) by 0 days.

(21) Appl. No.: 12/453,757

(22) Filed: May 21, 2009

(65) Prior Publication Data

US 2009/0298355 A1 Dec. 3, 2009

(30) Foreign Application Priority Data

May 28, 2008 (JP) ..... 2008-138954

(51) Int. Cl.
*H01R 13/15* (2006.01)
*H01R 13/62* (2006.01)

(52) U.S. Cl. ..... 439/260; 439/261; 439/495

(58) Field of Classification Search ..... 439/260, 439/261, 495, 494, 496, 329
See application file for complete search history.

(56) References Cited

U.S. PATENT DOCUMENTS 6,099,346 A * 8/2000 Hashiguchi et al. ..... 439/495
6,332,801 B1 * 12/2001 Watanbe ..... 439/409
6,837,740 B2 * 1/2005 Kunishi et al. ..... 439/495
6,851,968 B2 * 2/2005 Tsunematsu ..... 439/495
7,214,081 B1 5/2007 Ju
7,275,948 B2 * 10/2007 Miura et al. ..... 439/260
7,303,429 B2 * 12/2007 Kim ..... 439/495

FOREIGN PATENT DOCUMENTS

JP 2001-023711 1/2001
JP 2001-143827 5/2001
JP 2009-158279 7/2009

OTHER PUBLICATIONS

JPO Office Action, Apr. 12, 2010.

* cited by examiner

*Primary Examiner* — Hae Moon Hyeon
(74) *Attorney, Agent, or Firm* — Kubotera & Associates LLC

(57) ABSTRACT

An electrical connector is to be connected to a flat conductive member. The electrical connector includes a housing; a terminal held in the housing; and a pressing member supported on the supporting portion to be rotatable for pressing the flat conductive member against the terminal. The terminal includes a base portion, a contacting arm extending from the base portion, and a supporting portion facing the contacting arm. The contacting arm is arranged to form a space for receiving the flat conductive member between the contacting arm and the supporting portion. The contacting arm includes a first contacting portion and a second contacting portion. The first contacting portion is situated at a position closer to the supporting portion than the second contacting portion. The second contacting portion is situated at a position closer to the base portion than the first contacting portion.

8 Claims, 4 Drawing Sheets

ELECTRICAL CONNECTOR HAVING CONTACT PORTION

CROSS-REFERENCES TO RELATED APPLICATIONS

The disclosure of Japanese Patent Application No. 2008-138954, filed on May 28, 2008 is incorporated in the application by reference.

BACKGROUND OF THE INVENTION AND RELATED ART STATEMENT

The present invention relates to an electrical connector to be connected to a flat conductive member.

The flat conductive member includes a flexible printed circuit board (FPC) and a flat cable. The flat conductive member is often connected to an electrical connector (connector) mounted on a circuit board. Japanese Patent Publication, for example, has disclosed a conventional connector connected to the flat conductive member.

Patent Reference: Japanese Patent Publication No. 2001-143827

In the conventional electrical connector disclosed in Patent Reference, a plurality of terminals is made of a metal plate so that a flat surface of the metal plate is retained. The terminals are held with a housing so that the flat surfaces of the metal plates are parallel to each other in the housing. Each of the terminals includes a contacting arm (contact spring piece) at a lower side thereof and a supporting arm at an upper side thereof extending toward an opening of the housing for receiving the flat conductive member.

In the conventional electrical connector, a pressing member is disposed at the opening of the housing to be rotatable from an open position for receiving the flat conductive member easily to a closed position for pressing the flat conductive member to the contacting portion of the contacting arm after the flat conductive member is inserted. When the pressing member is at the open position, the flat conductive member is situated over the contacting portion of the contacting arm. Then, after the pressing member is rotated to the closed position, the pressing member presses the flat conductive member with a pressing portion thereof. Thereby, the flat conductive member contacts with the contacting portion of the contacting arm with a contacting pressure.

In the conventional connector described above, the terminal includes one contacting arm. The contacting arm includes contacting portions at two locations in an extending direction thereof for contacting with the flat conductive member steadily.

In the conventional connector described above, it is necessary to securely contact with the flat conductive member at the contacting portions thereof with a sufficient contacting pressure. Accordingly, it is desirable that the contacting arm elastically deforms by a large amount at a position of the contacting portion. To this end, in the conventional connector described above, the contacting portions are located close to a forefront portion of the contacting arm. Consequently, both of the contacting portions are situated close to each other and deform together.

Accordingly, in the conventional connector described above, when the flat conductive member is inserted into the connector, the two contacting portions situated on the one contacting arm contact with the flat conductive member almost concurrently. When the pressing member presses the contacting portions through the flat conductive member, the contacting portions deform concurrently by almost the same amount.

When the two contacting portions are not properly situated against the flat conductive member due to a designing error or a manufacturing error, even though the other of the contacting portions contacts with the flat conductive member with a proper contacting pressure, one of the contacting portions may not obtain a sufficient contacting pressure, thereby resulting in an unstable contact state.

In view of the problems described above, an object of the present invention is to provide an electrical connector to be connected to a flat conductive member including two contacting portions located independently with each other, and capable of obtaining a sufficient and steady contacting pressure with respect to the flat conductive member.

Further objects and advantages of the invention will be apparent from the following description of the invention.

SUMMARY OF THE INVENTION

In order to attain the objects described above, according to the present invention, an electrical connector to be connected to a flat conductive member (connector) includes a housing and a terminal formed of a metal plate so that a flat surface of the metal plate is retained. The terminal is held and aligned in the housing so that the flat surface of the metal plate becomes parallel to each other. The terminal includes a base portion having an attached portion, and a contacting arm extending from the base portion. The flat conductive member is inserted into a space formed between the contacting arm and a supporting portion facing the contacting arm.

The electrical connector further includes a pressing member disposed to be rotatable from an open position for receiving the flat conductive member easily to a closed position for pressing the flat conductive member. The pressing member is supported on the supporting portion to be rotatable. As the pressing member is rotated to the closed position, the flat conductive member is pressed by the pressing member, thereby contacting with the terminal.

According to the present invention, in the electrical connector, the terminal includes a first contacting portion situated formed on the contacting arm extending from the base portion and a second contacting portion situated at a position closer to the base portion than the first contacting portion. The first contacting portion is capable of elastic deformation and situated at a position closer to the supporting portion than the second contacting portion in a direction the contacting arm faces the supporting portion in a free state.

In the present invention described above, the flat conductive member is inserted into the space between the supporting portion and the contacting arm when the pressing member is at the open position. The first contacting portion formed on the contacting arm is situated at the position closer to the supporting portion than the second contacting portion formed on the base portion. Thereby, the flat conductive member is situated over the first contacting portion in a secure contact state therewith.

After the flat conductive member is inserted, when the pressing member is rotated to the closed position, the pressing member presses the first contacting portion through the flat conductive member to deform elastically. As a result, a distance between the first contacting portion and the second contacting portion decreases as the first contacting portion deforms elastically in a direction the contacting arm faces the supporting portion, in other words, a thickness direction of the flat conductive member. The first contacting portion deforms to a position at a level the same as that of the second contacting portion or deforms further with the second contacting portion deforming together. Consequently, the flat conductive member contacts with both of the first contacting portion and the second contacting portion steadily.

According to the present invention, it is preferable that the supporting portion is formed at a supporting arm being capable of an elastic deformation upon receiving a force from the pressing member. The second contacting portion situated at the closer side to the base portion than the first contacting portion can deform relatively by a reacting force generated by the elastic deformation of the supporting arm, even in a case that the second contacting portion does not deform elastically. Accordingly, the second contacting portion can contact with the flat conductive member with an elastic pressure. Thus it is possible to obtain a steady contact state with sufficient contacting pressure, together with the first contacting portion.

According to the present invention, it is preferable that the supporting portion is situated between the first contacting portion and the second contacting portion in a direction the flat conductive member is inserted. Thereby the flat conductive member is supported on the first contacting portion and the second contacting portion like a beam. When a pressing portion of the pressing member presses the flat conductive member by a reaction force from the supporting portion located between both of the first and second contacting portions, the flat conductive member can contact steadily with the first conductive member and the second conductive member.

According to the present invention, the contacting arm may include a first contacting arm and a second contacting arm. The first contacting arm extends from the base portion at a farther position than the second contacting arm. Further, the first contacting arm may be inclined, so that a forefront portion thereof becomes closer to the supporting portion in the direction the contacting arm faces the supporting portion.

As described above, in the present invention, the contacting arm includes the first contacting portion and the second contacting portion. The first contacting portion is formed on the contacting arm extending from the base portion. The second contacting portion is situated at a closer side to the base portion than the first contacting portion. The first contacting portion is capable of elastic deformation and situated at a closer position to the supporting portion than the second contacting portion in a direction the contacting arm faces the supporting portion in the free state. Accordingly, when the terminal is pressed through the flat conductive member, the first contacting portion deforms elastically by the flat conductive member, so that the flat conductive member contacts with the second contacting portion. Thereby, the flat conductive member can contact with both of the contacting portions steadily with the sufficient contacting pressure.

BRIEF DESCRIPTION OF THE DRAWINGS

FIGS. 2(A) and 2(B) are sectional views showing the electrical connector according to the embodiment of the present invention, wherein FIG. 2(A) is a sectional view when a pressing member is in a halfway from an open position to a closed position and FIG. 2(B) is a sectional view when the pressing member is at the closed position;

DETAILED DESCRIPTION OF THE PREFERRED EMBODIMENTS

Hereunder, embodiments of the present invention will be explained with reference to the accompanying drawings.

Figure 1:
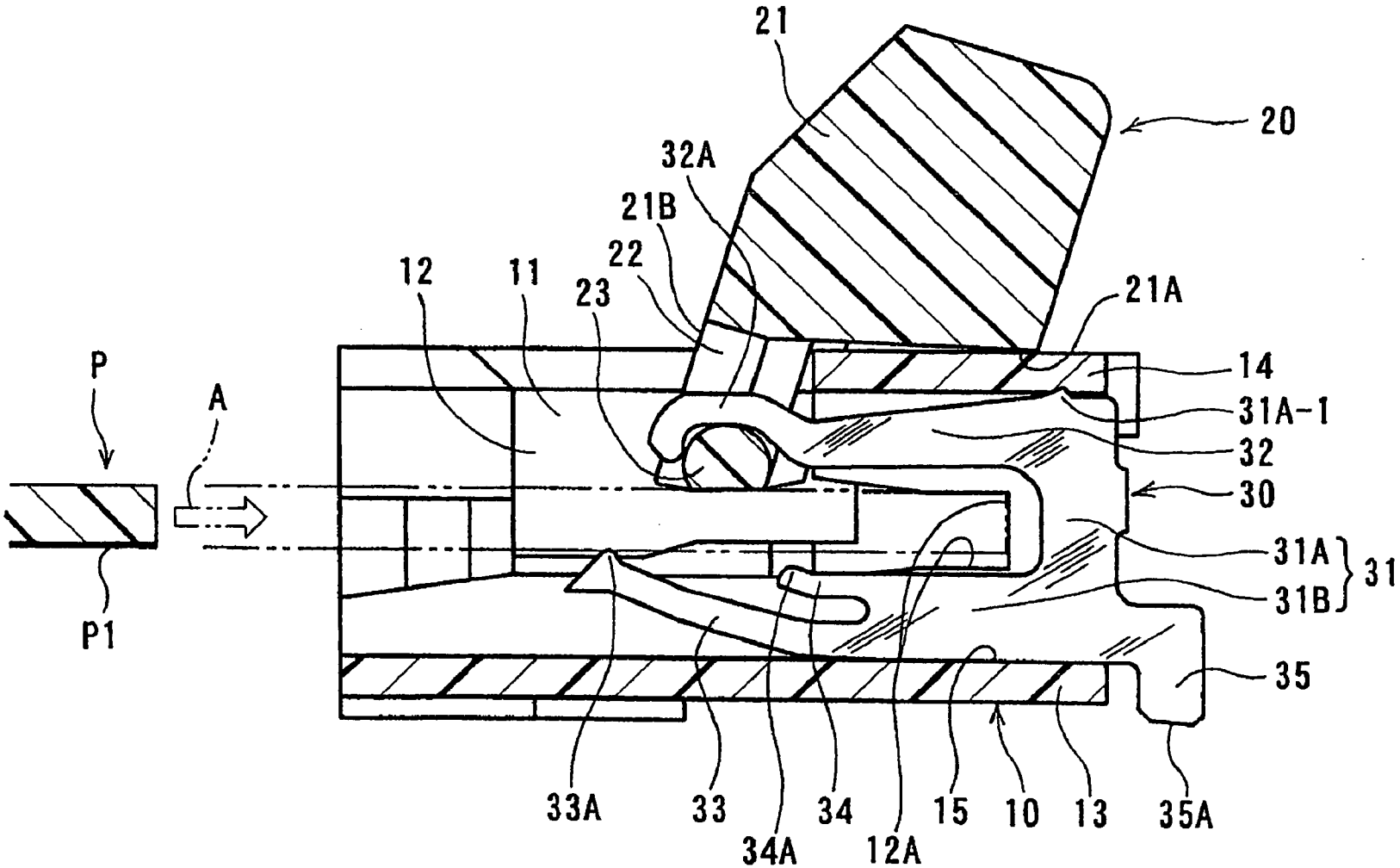
FIG. 1 is a sectional view showing an electrical connector for a flat conductive member according to an embodiment of the present invention.

FIG. 1 is a sectional view showing a connector for a flat conductive member (connector) according to the embodiment of the present invention. The connector includes a housing 10; a pressing member 20 for pressing a flat conductive member P being inserted into the housing 10; and a terminal 30 for contacting with the flat conductive member P with a contacting pressure through a contacting portion P1 formed on a lower surface of the flat conductive member P as the flat conductive member P is pressed. The terminal 30 is aligned in a direction perpendicular to a surface of a sheet, that is, a terminal-aligning direction or a width direction of the connector.

As shown in FIG. 1, the housing 10 having a horizontally long rectangular shape is made of an electrical insulating material and extends in the width direction. As shown in FIG. 1, the housing 10 includes an opening portion 12 opened except where a side wall 11 is located at an end thereof in the width direction. The opening portion 12 is opened in a rear direction, which is an opposite direction of a direction (a direction showed by an arrow A in FIG. 1) the flat conductive member P is inserted, and an upper direction. The pressing member 20 is placed in the opening of the opening portion 12. The housing 10 further includes a receiving groove 12A for receiving a front end portion of the flat conductive member P. The receiving grove 12A extends in a front direction from the opening portion 12. The receiving groove 12A is formed where the terminals are aligned in the width direction.

The housing 10 includes a bottom wall 13 placed on a circuit board (not shown) and an upper wall 14 at a front portion thereof facing the bottom wall 13. A terminal hole 15 having a slit shape is formed between the bottom wall 13 and the upper wall 14, for inserting the terminal 30. The terminal hole 15 is formed in a side of the bottom wall 13, a side of the upper wall 14, and a front side of the housing 10 except where the opening portion 12 and the receiving groove 12A are formed. Since the terminal 30 is formed so that a flat surface of a metal plate is retained and aligned so that the surface of the metal plate becomes parallel to the surface of the sheet, the terminal hole 15 has a slit width (an inner width of the slit in the terminal-aligning direction) corresponding to a thickness of the terminal 30 and aligned with a specific interval in the width direction.

The pressing member 20 is made of an electrical insulating material similar to that of the housing 10. The pressing member 20 is placed at the opening portion 12 of the housing 10 and extends over a range of the opening portion 12 in the width direction. The pressing member 20 includes an operating portion 21 located an upper side of the upper wall 14 when the pressing member 20 is in an open position as shown in FIG. 1; a groove portion 22 located a lower side of the operating portion and inside of the opening portion 12 of the housing 10; and a supported portion 23 with an island shape formed inside the groove portion 22. The pressing member 20 further includes a shaft portion (not shown) for supporting rotation thereof at an end thereof in the width direction.

Figure 2A:
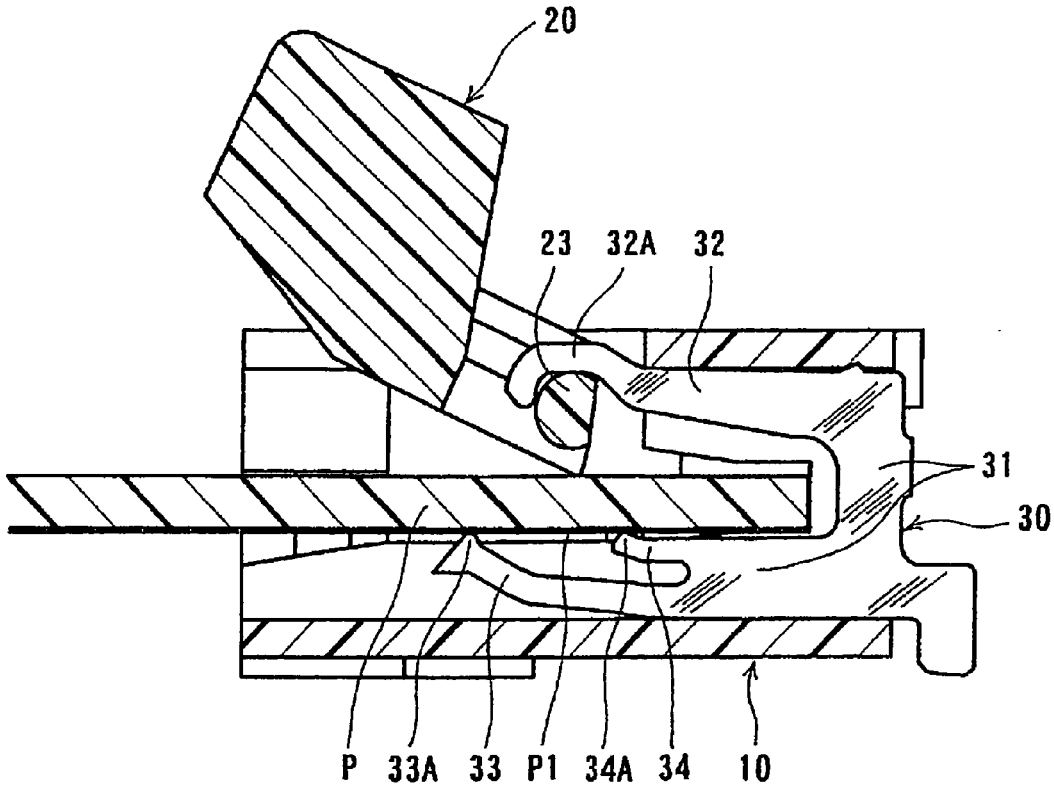
Figure 2B:
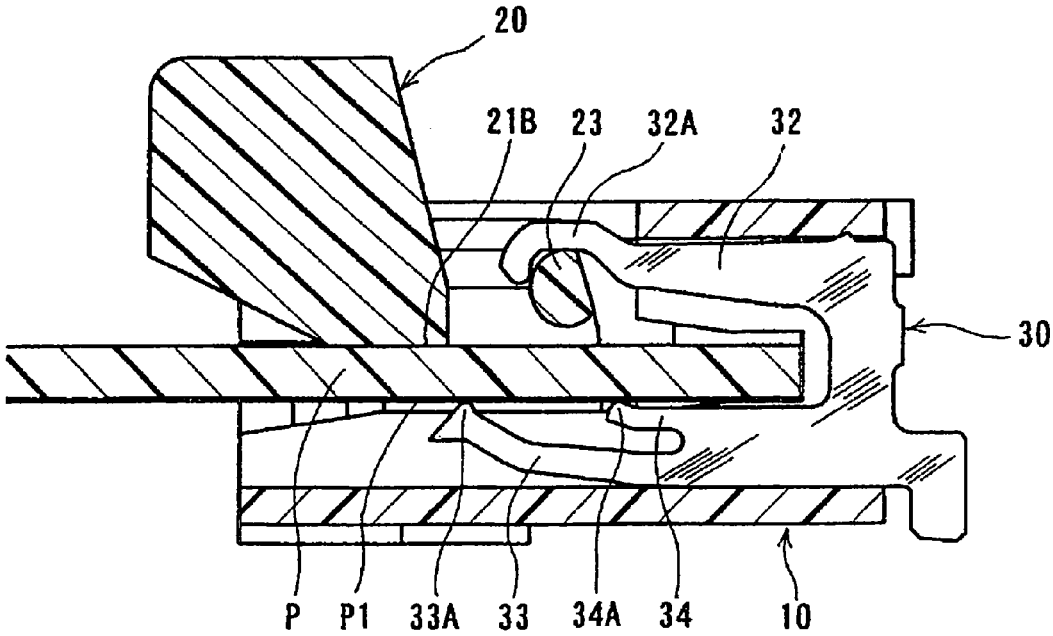

The operating portion 21 has a dimension large enough to be rotated by a finger of an operator from the open position shown in FIG. 1 to a closed position shown in FIG. 2(B). The groove portion 22 and the supported portion 23 are provided at a portion extending from a lower left end of the operating portion 21 in a lower direction. Further, an end surface is formed at a lower right end portion of the operating portion 21. The end surface forms a stopper portion 21A abutting against the upper wall 14 of the housing 10 when the pressing member 20 is fully opened. In addition, a pressing portion 21B is formed with a left side surface extending from the lower left end of the operating portion 21. As shown in FIG. 2(B), the pressing portion 21B presses the flat conductive member P when the pressing member 20 is at the closed position.

The groove portion 22 of the pressing portion 20 is formed so that a tip portion of a supporting arm (described later) of the terminal 30 can penetrate thereto. As shown in FIG. 1, the groove portion 22 is formed with a slit width (an inner width of the slit in the direction perpendicular to the surface of the sheet) corresponding to a thickness of the supporting arm, since the terminal 30 is formed of the metal plate having the surface parallel to the surface of the sheet. In addition, the supported portion 23 is formed inside and the lower side of the groove portion 22. The supported portion 23 also formed so as to connect inner surfaces of the groove portion 22 facing each other in the width direction.

As shown in FIG. 1, the supported portion 23 has a partial circular sectional shape at a side facing inside of the groove portion 22 and a linear sectional shape along a lower end surface of the pressing member 20 at a side facing outside of the groove portion 22 (a lower side in FIG. 1). As described later, a supporting portion of the supporting arm of the terminal 30 is located in the groove portion 22 and engages with a circular surface of the supported portion 23.

As described above, the terminal 30 is formed so that the flat surface of the metal plate is retained. As shown in FIG. 1, the terminal 30 includes a base portion 31; a supporting arm 32 extending in the rear direction (left) from the base portion 31; a first contacting arm 33; a second contacting arm 34; and a connecting portion 35 extending in the front direction (right) from the base portion 31. The supporting arm 32, the first contacting arm 33 and the second contacting arm 34 extend in the rear direction (left) from the base portion 31. The first contacting arm 33 and the second contacting arm 34 face the supporting arm 32 in a vertical direction to form a space for inserting the flat conductive member P.

The base portion 31 is to be pushed into the terminal hole 15 of the housing 10 and fixed thereto. As shown in FIG. 1, the base portion 31 includes a vertical portion 31A extending in the vertical direction at a front end portion of the terminal hole 15 and a horizontal portion 31B extending in a front and rear direction at a lower end portion thereof.

The base portion 31 has an L character shape flipped horizontally and is fixed to the housing 10 with the vertical portion 31A and the horizontal portion 31B. When the base portion 31 is pushed into the terminal hole 15, the base portion 31 is fixed to an upper edge and a lower edge of the terminal hole 15, with an upper edge of the vertical portion 31A and a lower edge of the horizontal portion 31B as attached portions. The horizontal portion 31B and a lower inner surface of the terminal hole 15 hold each other and a protrusion 31A-1 provided on an upper surface of the vertical portion 31A (the attached portion) cuts into an inner surface of the upper edge of the terminal hole 15, thereby preventing the terminal 30 from coming off.

The supporting arm 32 extends in the rear direction, from an upper portion of the vertical portion 31A of the base portion 31 to an outside the terminal hole 15. The supporting arm 32 extends in the rear direction with a decline so that an upper surface thereof becomes gradually apart from the inner surface of the upper edge of the terminal hole 15. Accordingly, a space is formed between the supporting arm 32 and the inner surface of the upper edge of the terminal hole 15. Thereby, the supporting arm 32 can deform elastically in the vertical direction. The supporting arm 32 includes a supporting portion 32A bent into a reverse U character shape at a rear end portion thereof.

The supporting portion 32A supports the supported portion 23 of the pressing member 20 with a lower edge of a portion having the reverse U character shape. The supporting portion 32A does not have to contact with the supported portion 23 constantly if the supporting portion 32A is supported the shaft portion (not shown) of the pressing member 20 located at the end thereof. The supporting portion 32A may contact with and support the supported portion 23 at least when the supported portion 23 displaces in the upper direction receiving a reaction force from the flat conductive member P as the pressing member 20 is rotated from the open position to the closed position.

The supporting arm 32 may have elasticity so as to deform in the vertical direction, or may not have elasticity. In the embodiment, the supporting arm 32 has elasticity and deforms in the upper direction when the supporting portion 32A receives the reaction force in the upper direction from the supported portion 23 of the pressing member 20. In this case, the deformation of the supporting arm 32 is Limited by a lower surface of the upper wall 14 of the housing 10 functioning as a stopper.

The first contacting arm 33 and the second contacting arm 34 extend in the rear direction from the horizontal portion 31B of the base portion 31 having a distance in between. The first contacting arm 33 and the second contacting arm 34 are formed so as to have widths narrower than the horizontal portion 31B, respectively. The first contacting arm 33 extends from a lower position of the base portion 31, where is farther from the contacting portion P1 of the flat conductive member P than the second contacting arm 34.

The first contacting arm 33 also extends in the rear direction farther than the second contacting arm 34. Consequently, the first contacting arm 33 can deform elastically by a larger amount than the second contacting arm 34 upon receiving a force in the vertical direction, since the first contacting arm 33 can have a longer spring length than that of the second contacting arm 34. The first contacting arm 33 and the second contacting arm 34 include a first contacting portion 33A and a second contacting portion 34A protruding in the upper direction at rear ends thereof, respectively. The first contacting arm 33 is inclined in the upper direction as extending in the rear direction, and the first contacting portion 33A at the rear end of the first contacting arm 33 is situated at a position upper than the second contacting portion 34A at the rear end of the second contacting arm 34.

Further, the terminal 30 includes the connecting portion 35 protruding in the front direction from a lower front end of the base portion 31 and bent into the lower direction. The connecting portion 35 has a reverse L character shape. A lower end edge 35A of the connecting portion 35 is situated at a position contacting with a corresponding circuit portion of the circuit board and soldered to the corresponding circuit portion when the connector is placed on the circuit board.

Hereunder, in the embodiment described above, a way to use and a way of working will be explained.

(1) First, as shown in FIG. 1, the pressing member 20 is set in the open position, that is, set in a position standing upright. When the pressing member 20 is set in the open position, the opening portion 12 of the housing 10 is opened widely in the rear direction, thereby the flat conductive member P can be inserted easily. As indicated with a projected line in FIG. 1, the flat conductive member P is inserted in the front direction or the direction of the arrow A into the opening portion 12.

(2) As the flat conductive member P is inserted further, the front end portion of the flat conductive member P enters into the receiving groove 12A and abuts against a front end surface thereof. Thus the front end portion of the flat conductive member P is settled into a predetermined inserted position. In the state described above, the contacting portion P1 of the flat conductive member P contacts with the first contacting portion 33A of the terminal 30 since the first contacting portion 33A is situated at the position upper than the second contacting portion 34A. In this state, the contacting portion P1 contacts lightly and unstably, or does not contact with the second contacting portion 34A.

(3) The pressing member 20 is rotated to the closed position shown in FIG. 2(B), through a state shown in FIG. 2(A). The pressing member 20 presses the flat conductive member P with the pressing portion 21B thereof. Accordingly, the flat conductive member P presses the first contacting portion 33A in the lower direction. When the first contacting portion 33A is pressed in the lower direction, the first contacting portion 33A deforms elastically in the lower direction and displaces to the same level with the second contacting portion 34A in a height direction. As a result, the flat conductive member P contacts with the second contacting portion 34A steadily, as well as the first contacting portion 33A.

(4) As the pressing member 20 rotates further and is set in the closed position, both of the first contacting portion 33A and the second contacting portion 34A are pressed in the lower direction. Thereby, both of the first contacting portion 33A and the second contacting portion 34B can contact with contacting portion P1 of the flat conductive member P with a sufficient contacting pressure.

(5) In the embodiment, the space is formed between the supporting arm 32 and the upper wall 14 of the housing 10. Accordingly, the supported portion 23 of the pressing member 20 pressing the flat conductive member P in the lower direction displaces elastically in the upper direction upon receiving the reaction force from the flat conductive member P as the pressing member 20 is rotated from the open position to the closed position. The supported portion 23 is pressed in the lower direction by an elastic energy generated by the elastic deformation. As a result, the contacting pressure of the flat conductive member P against the first contacting portion 33A and the second contacting portion 34A increases further.

In the present invention, it is possible to modify in many ways, not limited to the embodiment shown in FIGS. 1 and 2(A)-2(B). The second contacting portion 34A may not be capable of the elastic deformation. For example, as shown in FIG. 3, the second contacting portion 34A can be situated at an upper rear end edge of the horizontal portion 31B of the base portion, thus the second contacting portion 34A does not deform elastically.

Similar to the embodiment described above, the first contacting portion 33A deforms elastically in the lower direction, from the position upper than the second contacting portion 34A to the same level with the second contacting portion 34A in the height direction. Consequently, the flat conductive member P also contacts with the second contacting portion 34A steadily.

Figure 3:
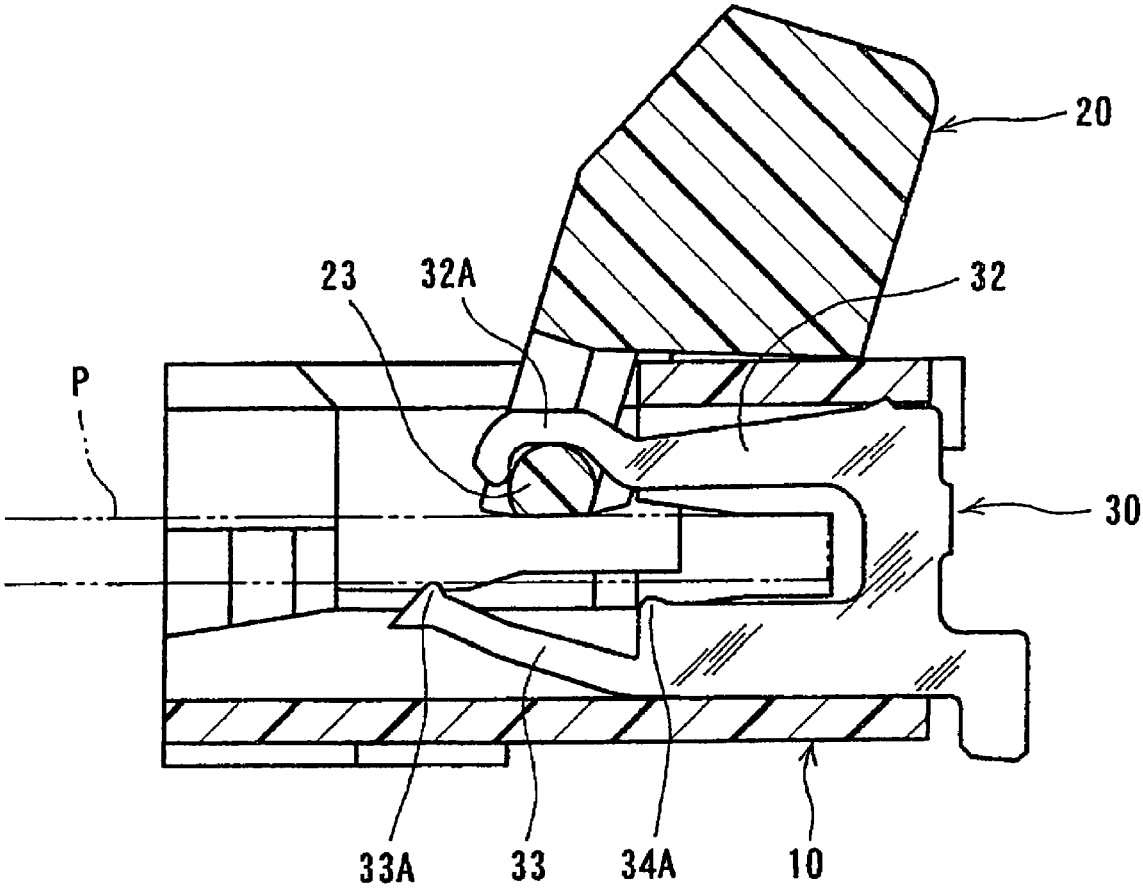
FIG. 3 is a sectional view showing a modified example of the electrical connector according to the embodiment of the present invention.

In the variation shown in FIG. 3, if the supporting arm 32 is capable of an elastic deformation, it is also possible for the flat conductive member P to contact relatively with the second contacting portion 34A with an elastic pressure by an elastic energy of the supporting arm 32, without the elastic deformation of the second contacting portion 34A. In the variation described above, it is possible to downsize the connector in a front to rear direction.

Further, as opposed to the cases that each of the terminal 30 includes the first contacting arm 33 having the first contacting portion 33A, the second contacting arm 34 having the second contacting portion 34A and the supporting arm 32, as the embodiments shown in FIGS. 1 to 3, it is not necessary for each terminal to have all of them.

Figure 4:
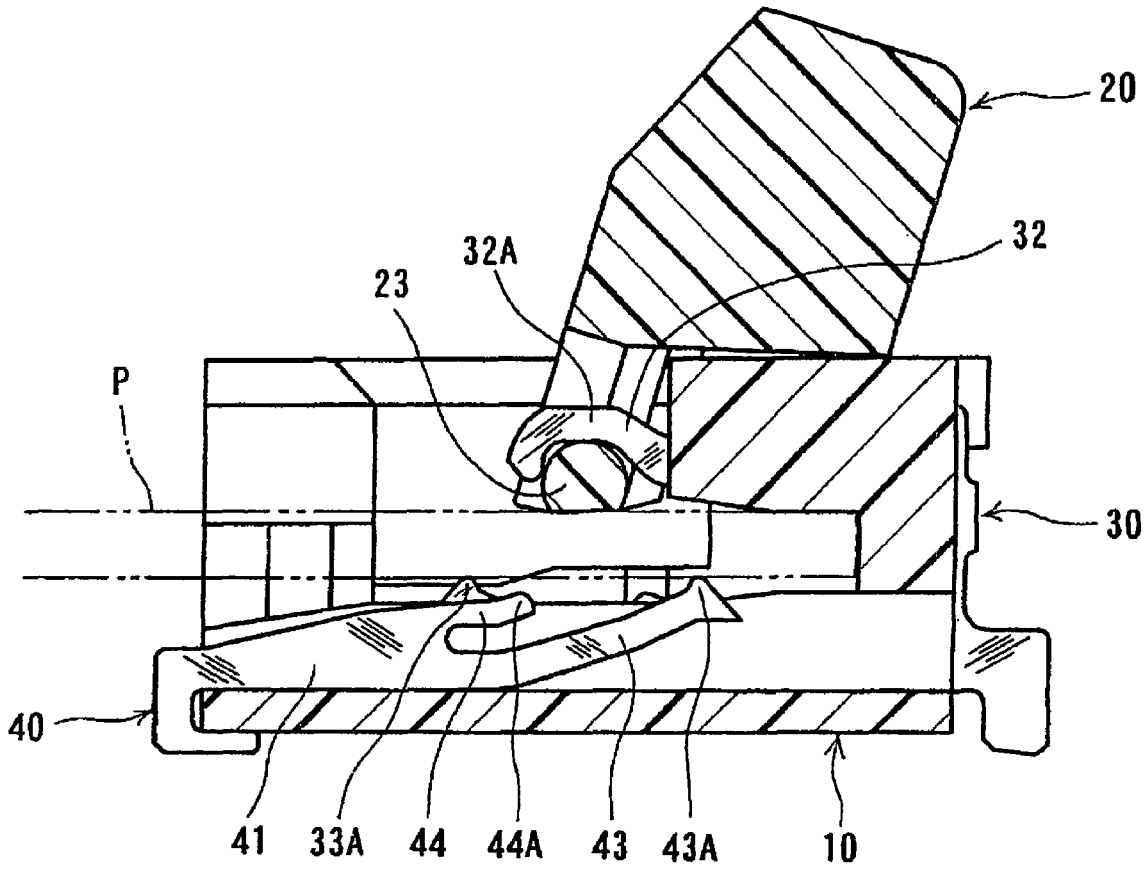
FIG. 4 is a sectional view showing another modified example of the connector according to the embodiment of the present invention.

In a variation shown in FIG. 4, the terminal 30 and a second terminal 40 are aligned alternately. The second terminal 40 is inserted into the housing in an opposite direction to the terminal 30 and includes only a first contacting arm 43 and a second contacting arm 44 without a supporting arm. Similar to the cases described above, a first contacting portion 43A of the first contacting arm 43 is situated apart from a second contacting portion 44A of the second contacting arm 44, and situated at an upper position than the second contacting portion 44A. The first contacting portion 33A of the terminal 30 and the first contacting portion 43A of the second terminal 40 are situated apart from each other in the direction the flat conductive member P is inserted.

As shown in FIG. 4, in the variation, since the terminal 30 and the second terminal 40 are aligned alternately, the connecting portions being soldered to the circuit board have twice as wide intervals between the next to each other as the terminals. Accordingly, as compared to the case that the terminals in a single kind are aligned as shown in FIG. 1, it is possible to align the terminals with higher density. As a result, it is possible to downsize the connecter in the terminal-aligning direction or the width direction.

The embodiments described above as the connector placed horizontally on the circuit board, can be applied to a connector placed vertically on the circuit board, rotating the connector by ninety degrees.

The disclosure of Japanese Patent Application No. 2008-138954, filed on May 28, 2008 is incorporated in the application by reference.

While the invention has been explained with reference to the specific embodiments of the invention, the explanation is illustrative and the invention is limited only by the appended claims.

What is claimed is:

1. An electrical connector to be connected to a flat conductive member, comprising:

a housing;

a terminal held and aligned in the housing in parallel to a first direction that the flat conductive member is inserted into the electrical connector, said terminal including a base portion, a first contacting arm extending from the base portion at a first position, a second contacting arm extending from the base portion at a second position shifted from the first position in a second direction perpendicular to the first direction, and a supporting portion facing the first contacting arm and the second contacting arm in the second direction to form a space for receiving the flat conductive member, said first contacting arm including a first contacting portion and said second contacting arm including a second contacting portion, said first contacting portion being situated at a position closer to the supporting portion than the second contacting portion along the second direction, said second contacting portion being situated at a position closer to the base portion than the first contacting portion along the first direction; and a pressing member supported on the supporting portion to be rotatable for pressing the flat conductive member against the terminal.

2. The electrical connector according to claim 1, wherein said terminal is formed of a metal plate so that a flat surface thereof is retained.

3. The electrical connector according to claim 1, wherein said base portion includes a vertical portion and a horizontal portion as attached portions attached to the housing.

4. The electrical connector according to claim 1, wherein said supporting portion is formed as a supporting arm being capable of an elastic deformation upon receiving a force from the pressing member.

5. The electrical connector according to claim 1, wherein said supporting portion includes a rotation supporting portion situated at a position between the first contacting portion and the second contacting portion in the first direction.

6. The electrical connector according to claim 1, wherein said first contacting portion protudes upward farther than the second contacting portion in the second direction.

7. The electrical connector according to claim 6, wherein said first contacting portion is inclined so that a forefront portion thereof becomes closer to the supporting portion than the second contacting portion in the second direction.

8. The electrical connector according to claim 1, wherein said first contacting arm extends from the base portion by a first length, the second contacting arm extending from the base portion by a second length smaller than the first length.

* * * * *